US005207030A

United States Patent [19]

Herrmann

[11] Patent Number: 5,207,030

[45] Date of Patent: May 4, 1993

[54] DEVICE FOR HOLDING SMALL GLASS PIECES FOR GRINDING

[76] Inventor: Heinz Herrmann, Leipziger Strasse 105, D-4154 Tönisvorst 1, Fed. Rep. of Germany

[21] Appl. No.: 885,060

[22] Filed: May 15, 1992

Related U.S. Application Data

[63] Continuation of Ser. No. 714,653, Jun. 13, 1991, abandoned.

[30] Foreign Application Priority Data

Jan. 9, 1991 [DE] Fed. Rep. of Germany ... 9100199[U]

[51] Int. Cl.[5] ..... B24B 41/06

[52] U.S. Cl. ..... 51/217 R; 51/217 P; 269/254 R

[58] Field of Search ..... 51/217 R, 217 P, 218 R, 51/218 P, 216 R, 216 P; 81/415, 427.5, 418, 420, 488, 487; 30/340, 341, 298; 269/95, 96, 254 R, 3, 6

[56] References Cited

U.S. PATENT DOCUMENTS

| | | | |
|---|---|---|---|
| 3,129,029 | 4/1964 | Ruzza | 81/415 |
| 4,635,363 | 1/1987 | Chapin | 30/341 |
| 4,961,291 | 10/1990 | Lagassea | 51/217 P |

*Primary Examiner*—M. Rachuba
*Attorney, Agent, or Firm*—Herbert Dubno

[57] ABSTRACT

A pliers for gripping small pieces of glass to be ground as a support foot which can ride on a surface from which the grinder projects and a clamping jaw which can hold the piece of glass against a resting surface formed on this foot.

4 Claims, 2 Drawing Sheets

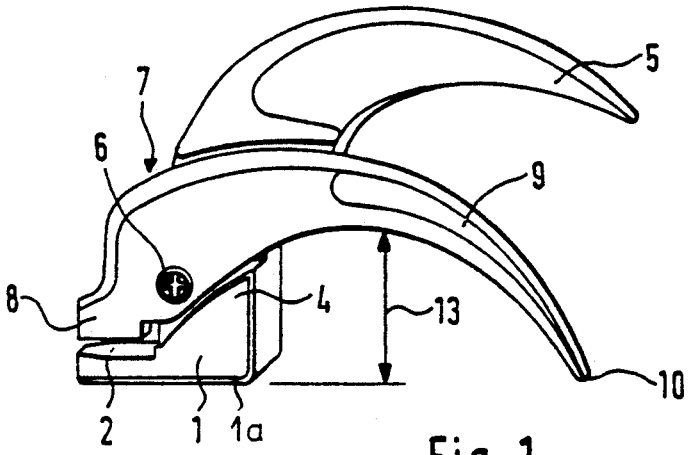
Fig. 1
Fig. 2
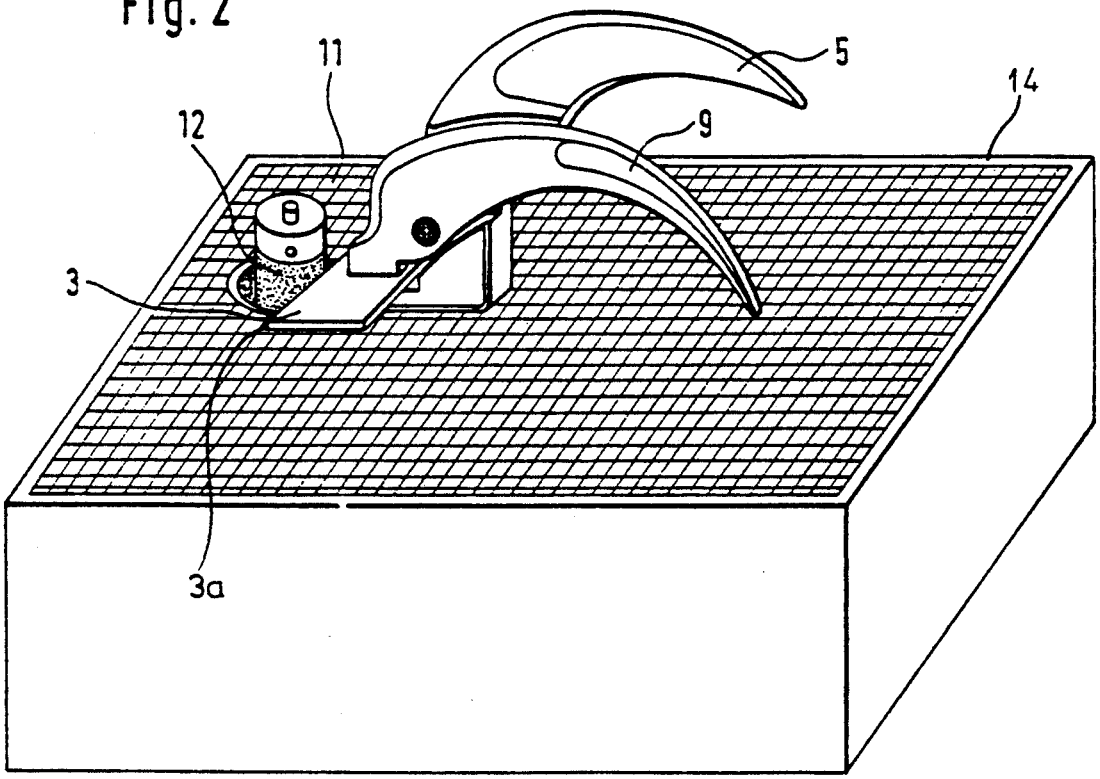

DEVICE FOR HOLDING SMALL GLASS PIECES FOR GRINDING

This is a continuation of co-pending application Ser. No. 07/714,653, filed on Jun. 13, 1991, now abandoned.

FIELD OF THE INVENTION

My present invention relates to a device for holding small glass pieces for the grinding of glass and, more particularly, to a holder or gripper for small glass pieces which can enable an edge of the piece thus held to be thrust in a uniform manner against a glass grinder.

BACKGROUND OF THE INVENTION

In the grinding of glass, for example, in the production of leaded glass, stained glass, or other forms of ornamental glass, especially Tiffany-type lamps, glass decor, mirrors and the like, to form small pieces of glass of particular colors or textures in very specific shapes or dimensions by cutting the pieces from a larger piece of glass, the cutting operation generally involves scoring and breakage against a score line. In the breaking of the glass to form such pieces, sharp edges may result and these edges must be ground at least in part for safe handling. It is also necessary in many cases to grind glass pieces for shaping or for imparting a certain degree of dimensional accuracy thereto.

In the grinding of small glass pieces, it has been found that it is difficult to hold the glass piece with the requisite pressure against the grinder. In practice, this has been recognized in the past and indeed rods, bars or other pushers have been used to press a glass piece along a guide surface against a grinder. In most cases, however, the fingers must also be used and there is a substantial danger of injury to the finger.

OBJECTS OF THE INVENTION

It is, therefore, the principal object of the present invention to provide a device for the slip-free retention of small glass pieces which will allow the grinding thereof without danger to the user and, specifically, will permit a pressing of the small piece of glass with high precision against the grinding surface.

SUMMARY OF THE INVENTION

These objects are attained, in accordance with the invention, in a glass-gripping pliers having a support foot adapted to ride against a guide surface and which can be used to press a small glass piece held in the pliers against a grinding wheel which preferably is rotatable about an axis perpendicular to this surface, the glass-gripping pliers comprising a pair of clamping jaws which can be moved together to engage a small glass piece between them and one of which is formed with a foot adapted to ride along the surface.

The glass piece can thus be gripped without difficulty between the jaws and together with the pliers move against the grinding wheel. The piece of glass need never be covered by a finger so that a portion be covered by a finger so that the portion to be ground remains clearly visible and there is no danger of injury.

According to a feature of the invention, the support foot or shoe has, in addition to a surface slidable along the guide surface, a journaling projection on the other clamping shoe which is pivotable about an axis parallel to the plane of the guide surface and the foot. This construction means that the support surface of the foot upon which the piece of glass is supported can be free on three sides since the journaling projection lies only at a fourth side of this surface.

To improve the retaining force between the resting surface upon which the piece of glass lies and the other clamping jaw, the resting surface and/or the juxtaposed clamping surface of the clamping jaw can be roughened, textured or otherwise provided with a multiplicity of formations so as to increase frictional resistance between the piece of glass and the supported or clamping surfaces. This roughened surface can be formed by emery cloth or emery paper bonded by an adhesive to the resting surface or the clamping surface.

The bearing projection of the support foot can, in addition, be formed with a fixed handle or grip with which the pliers can be engaged by the user and moved. The clamping jaw, in turn, can have the configuration of a double-arm lever, one arm of which forms the clamping jaw while the other also constitutes a grip or handle. It is possible, in this arrangement, to hold the pliers with one hand to guide it. It has been found to be especially advantageous to form the grip of the clamping jaw with a weight distribution such that, upon release of the grips, the pliers will fall open. This eliminates the need for a spring to effect the opening movement of the pliers.

The pliers are displaceable on a work plate above which the grinding wheel projects and it has been found to be advantageous when the grip attached to the support foot is bent downwardly toward the plate and provides additional support against tilting of the foot on the plate.

BRIEF DESCRIPTION OF THE DRAWING

The above and other objects, features and advantages of the present invention will become more readily apparent from the following description, reference being made to the accompanying drawing in which:

FIG. 1 is a perspective view showing a gripping pliers capable of holding a piece of glass for grinding;

FIG. 2 is an illustration of the gripping pliers in place on a work plate, showing the piece of glass gripped thereby and the grinding wheel;

SPECIFIC DESCRIPTION

Figure 3:
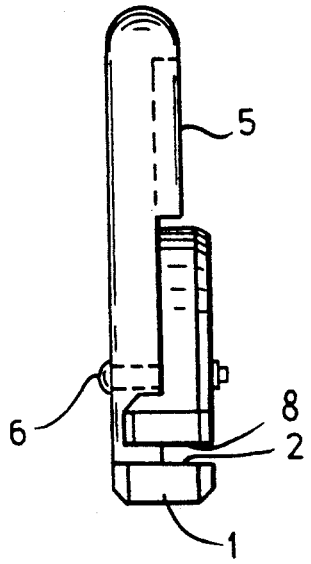
FIG. 3 is a front end view of the pliers.
Figure 4:
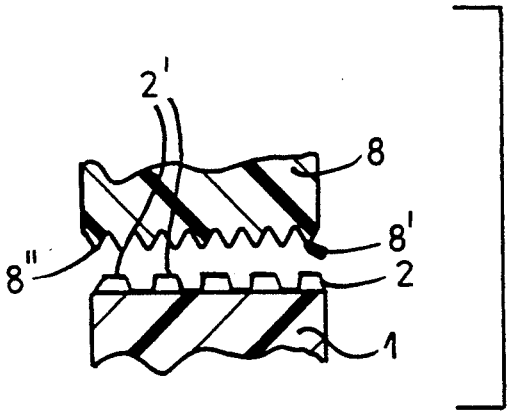
FIG. 4 is an enlarged cross sectional view through the parts of the device forming the resting surface and the clamping surface of the pliers.

The gripping pliers of the invention as illustrated in FIGS. 1-4 comprise a support foot 1 with a planar lower guide surface 1*a* adapted to ride along a surface 11 of a work plate 14 from which a grinding wheel 12 projects with its axis of rotation perpendicular to this latter surface. In addition, the foot 1 has a surface 2 upon which a small piece of glass 3 to be ground can rest, this piece of glass being illustrated only in FIG. 2.

On the support foot 1 and formed unitarily therewith, is an upwardly-extending journaling projection 4 which extends further into a downwardly bent grip or handle 5. The handle 5 is disposed above the surface 11 of a work plate 14 in operation (compare FIGS. 1 and 2).

A pin 6 in the region of the projection 4 forms a journal for a double-arm lever 7 so that the latter can pivot about an axis parallel to the surfaces 2, 1*a* and 11.

One arm of this lever 7 is a clamping jaw 8 while the other arm is formed as a hand grip 9 and is bent downwardly toward the surface 11. The jaw 8 has a clamping surface 8'juxtaposed with the resting surface 2. These surfaces are intended to engage the piece 3 between them. Both surfaces can be roughened to decrease the tendency of the piece 3 to slip. In the drawing, this roughening has been indicated in FIG. 4 by uniform teeth 8" formed in the surface 8', or a uniform array of projections 2' formed in the surface 2. Of course, a piece of emery cloth can be secured to either or both of the surfaces by an adhesive.

The grip 9 of the jaw 8 is bent downwardly sufficiently so that its tip will rest on the surface 11 when the pliers are released and will support the pliers in an open position. Thus, the grip 9 will have such a weight distribution that the pliers, upon manual release of the grips, will automatically open.

FIG. 2 shows the pliers in operation. The support foot 1 is supported on and guided on the surface 11 of the plate 14 from which the grinding wheel 12 projects with its axis perpendicular to the surface 11.

The glass piece 3, to be ground along its edge 3*a*, is held between the jaws 1 and 8 by a slight counterclockwise torque manually applied to the handle 9 as the pliers are shifted along the surface 11 with the edge 3*a* being moved back and forth across the grinding wheel. The piece 3 projects on the three free sides of the support surface 2 and the edge 3 can be shaped by proper manipulation of the pliers. Both grips 5 and 9 are so formed that in spite of the practically simultaneous contact of the surfaces 1*a* and 10 with the surface 11, there is sufficient space 13 to enable the pliers to be gripped and manually displaced.

I claim:

1. A device for grinding small pieces of glass comprising:

a work table formed with a horizontal work surface;

a grinder projecting through said surface and rotatable about an axis perpendicular to said work surface; and a pliers for gripping a small piece of glass riding on said work surface, said pliers comprising:

an L-shaped support foot having a flat support surface resting upon said work surface, and a resting surface parallel to said support surface, a journaling projection extending upwardly from said support foot along one side of said resting surface, and formed with an upwardly convex curvilinear grip bent toward said work surface from said projection and terminating above said work surface and a pivot located above said flat support surface between ends thereof, and a double-arm lever fulcrumed on said pivot and having:

a clamping jaw formed as one arm pivotally mounted on said projection and clamping said piece against said resting surface in a closed position of said pliers, and a curvilinear other arm formed as a grip bent toward said work surface and having a free end spaced from said foot, said other arm being upwardly convex and downwardly concave, said free end being supported on said work surface in an open position of said pliers upon release of said grips and being substantially coplanar with said support surface of said foot in said open position.

2. The pliers defined in claim 1 wherein said other arm has a weight distribution such that, upon release of said pliers, said pliers automatically opens to release said piece.

3. The device defined in claim 1 wherein said jaw and said resting surface are roughened to engage said piece between them.

4. The device defined in claim 1, said pivot further comprising a pivot pin extending parallel to said resting surface and traversing said double-arm lever and said projection for pivotally mounting said double-arm lever on said projection.

* * * * *